US009028052B2

(12) United States Patent
Takemoto et al.

(10) Patent No.: US 9,028,052 B2
(45) Date of Patent: May 12, 2015

(54) DROPLET DISCHARGING HEAD AND IMAGE FORMING APPARATUS

(71) Applicants: Takeshi Takemoto, Kanagawa (JP); Hitoshi Kida, Kanagawa (JP)

(72) Inventors: Takeshi Takemoto, Kanagawa (JP); Hitoshi Kida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/513,412

(22) Filed: Oct. 14, 2014

(65) Prior Publication Data

US 2015/0029270 A1 Jan. 29, 2015

Related U.S. Application Data

(62) Division of application No. 13/371,687, filed on Feb. 13, 2012, now Pat. No. 8,899,730.

(30) Foreign Application Priority Data

Feb. 18, 2011 (JP) ..... 2011-033850

(51) Int. Cl.
*B41J 2/045* (2006.01)
*B41J 2/14* (2006.01)

(52) U.S. Cl.
CPC ..... *B41J 2/04541* (2013.01); *B41J 2/14201* (2013.01); *B41J 2/04581* (2013.01)

(58) Field of Classification Search
CPC ..... B41J 2/14233; B41J 2/161; B41J 2/1646; B41J 2/14274; H01L 41/0973
See application file for complete search history.

(56) References Cited

U.S. PATENT DOCUMENTS

| | | | |
|---|---|---|---|
| 5,889,539 | A | 3/1999 | Kamoi et al. |
| 6,190,006 | B1 | 2/2001 | Kurashima et al. |
| 7,585,060 | B2 | 9/2009 | Kanaya |
| 7,732,989 | B2 | 6/2010 | Sugahara et al. |

(Continued)

FOREIGN PATENT DOCUMENTS

| | | |
|---|---|---|
| JP | 9-123449 | 5/1997 |
| JP | 11-300956 | 11/1999 |
| JP | 2006-116767 | 5/2006 |
| JP | 2007-331137 | 12/2007 |

(Continued)

OTHER PUBLICATIONS

Japanese official action dated Sep. 30, 2014 in corresponding Japanese patent application No. 2011-033850.

*Primary Examiner* — Lisa M Solomon
(74) *Attorney, Agent, or Firm* — Cooper & Dunham LLP

(57) ABSTRACT

A droplet discharging head includes: a nozzle substrate that includes a nozzle opening to discharge a droplet therethrough; a liquid chamber substrate that includes liquid pressure chambers communicating with the nozzle openings; a vibration plate arranged to face the nozzle substrate with the liquid chamber substrate interposed therebetween; piezoelectric elements that are provided to face the liquid pressure chambers with the vibration plate interposed therebetween and are arranged in a predetermined direction; a driving element provided, in a flip-chip implementation, on a flow path substrate that includes the nozzle substrate, the liquid chamber substrate, the vibration plate, and the piezoelectric elements; and a first reinforcing wire that is disposed to at least one of the flow path substrate and the driving element, has a band shape extending in a direction along a row of the piezoelectric elements, and is connected to a common electrode shared by the piezoelectric elements.

6 Claims, 9 Drawing Sheets

(56) References Cited

U.S. PATENT DOCUMENTS

| | | | | |
|---|---|---|---|---|
| 2003/0020787 | A1 | 1/2003 | Nakamura et al. | |
| 2003/0085961 | A1 | 5/2003 | Furuhata | |
| 2007/0285470 | A1 | 12/2007 | Kanaya | |
| 2009/0207213 | A1 * | 8/2009 | Tsuda | 347/70 |
| 2010/0302323 | A1 | 12/2010 | Yagi et al. | |

FOREIGN PATENT DOCUMENTS

| | | | |
|---|---|---|---|
| JP | 4258605 | | 2/2009 |
| JP | 2009-154519 | | 7/2009 |
| WO | WO01/624991 | A1 | 8/2001 |

* cited by examiner

DROPLET DISCHARGING HEAD AND IMAGE FORMING APPARATUS

CROSS-REFERENCE TO RELATED APPLICATIONS

This application is a divisional of U.S. patent application Ser. No. 13/371,687 flied Feb. 13, 2012 which claims prior to and incorporates by reference the entire contents of Japanese Patent Application No. 2011-033850 filed in Japan on Feb. 18, 2011.

BACKGROUND OF THE INVENTION

1. Field of the Invention

The present invention relates to a droplet discharging head and an image forming apparatus.

2. Description of the Related Art

An image forming apparatus such as an inkjet recording apparatus has various advantages such as high image quality, flexibility in coping with high speed printing, easy selection of ink types, usability of inexpensive plain sheets, and the like. Among the image forming apparatuses, a so-called "ink-on-demand type" droplet discharging device has been in wide use for the capability of discharging ink droplets only when the ink is needed because collection of ink droplets unnecessary for recording is not required.

As a droplet discharging head used in the droplet discharging device, there is a known configuration including a nozzle opening for discharging a droplet such as an ink droplet, a liquid pressure chamber (also, referred to as a discharging chamber, a pressurization chamber, an ink flow path, or the like) which communicates with the nozzle opening, and a pressure generating unit for generating a pressure for pressurizing the ink in the liquid pressure chamber. In the droplet discharging head having such a configuration, the ink droplet is discharged from the nozzle opening by pressurizing the ink in the liquid pressure chamber using the pressure generated by the pressure generating unit.

There is a known type of a droplet discharging head in which a piezoelectric element is used as the droplet discharging head and a vibration plate that forms a wall surface of the liquid pressure chamber is deformed and displaced for discharging the droplet. As the droplet discharging head in which the piezoelectric element is used, there are known types such as a longitudinal vibration type which uses the displacement of the piezoelectric element in the d33 direction (displacement in a direction perpendicular to the electrode surface (thickness direction)), a transverse vibration type (a so-called bending mode type) which uses the displacement of the piezoelectric element in the d31 direction (displacement in a direction parallel to the electrode surface), and a shear mode type which uses shearing deformation of the piezoelectric element.

Among these types, in recent years, with the establishment of a pattern processing technology and a reduced cost due to the advancement of a semiconductor process or a technology in micromachining, an actuator configuration has been proposed to directly form a liquid pressure chamber or a piezoelectric element on a Si substrate. By using this technology, the piezoelectric element can be provided using a precise and simple method, such as lithography, so as to reduce the thickness of the piezoelectric element, thereby realizing high-speed driving.

In this configuration, the droplet discharging head includes a driving element that controls the driving of the piezoelectric element. The driving element is implemented on the substrate on which the liquid pressure chamber and the piezoelectric element are provided. In addition, the driving element is connected to each piezoelectric element by wire bonding or flip-chip bonding (refer to Japanese Patent Application Laid-open No. 2004-001366 and Japanese Patent Application Laid-open No. 2006-116767).

In a case where the driving element is implemented on the substrate using the wire bonding method, there is a lot of flexibility in configuring wiring compared to the flip-chip bonding method. However, in miniaturizing the droplet discharging head, a simple use of the wire bonding method is insufficient and piezoelectric elements have to be highly densely arranged. However, as the droplet discharging head is miniaturized, the piezoelectric elements need to be integrated at a high density. This causes problems in that wires may make contact with each other to cause shorting out of a circuit and reduction in production efficiency.

That is, a high-density arrangement of the piezoelectric elements contributes to miniaturization of the droplet discharging head, increase in the number of chips available from a wafer for use in forming the droplet discharging heads, and reduction in production cost. However, because of the above problems, the pitch between wires bonded by the wire bonding method cannot be decreased below about 60 μm, so that there is a limit in the miniaturization of the droplet discharging head.

Regarding the wire bonding method, wire bonding has to be performed for each piezoelectric element, one by one. This hinders improvement of production efficiency.

Meanwhile, when the driving element is provided on the substrate with a flip-chip implementation, the driving element is bonded to each of the piezoelectric elements through protruding electrodes (bumps) formed on the driving element. In a case where the driving element is provided on the substrate in a flip-chip implementation, the driving element and each of the piezoelectric elements can be directly bonded to each other using the bump without using the wire. Therefore, the flip-chip method is advantageous in terms of high production efficiency because it is not required to perform wire bonding for the piezoelectric elements one by one. In addition, because the flip-chip method does not use the wire bonding, shorting out of a circuit due to a high density arrangement of the piezoelectric elements can be suppressed.

Here, irrespective of whether the wire bonding method or the flip-chip method is adopted for implementing the driving element on the substrate, it is necessary to provide the piezoelectric elements at a high density so as to miniaturize the droplet discharging head. However, as the piezoelectric elements are arranged at a higher density, a frequency that the ink droplets are simultaneously discharged by simultaneous driving of a plurality of piezoelectric elements increases. Due to the simultaneous operation of the piezoelectric elements, a voltage drop may occur, causing a variation in the amounts of ink droplets to be discharged.

In addition, the voltage of the driving signal for the droplet discharge is likely to be lowered for the piezoelectric element that is provided away from the connection terminal to which the driving signal is externally input. Therefore, if a plurality of piezoelectric elements arranged in a predetermined direction is simultaneously driven, the voltage applied to drive the piezoelectric element located farther from the connection terminal is likely to be lowered and hence a voltage drop is more likely to occur.

From the viewpoint of implementing a thin device, an electrode of the piezoelectric element formed through thin-film forming techniques such as sputtering, vacuum deposition, chemical vapor deposition (CVD), and the like has a small thickness and thus has a relatively high resistance value. Accordingly, the problems described above are likely to occur in this type of electrodes.

As a method for solving such a voltage drop problem, Japanese Patent Application Laid-open No. 2004-001366 discloses a technology which connects a common lead electrode to a common electrode of the piezoelectric elements. This common lead electrode is a wiring electrode, extending from a portion of the pressure generating chamber except for an end portion in the parallel arrangement direction to an area outside of the pressure generating chamber. In addition, in Japanese Patent Application Laid-open No. 2004-001366, each of the common lead electrodes is connected using a connection wire formed using a wire bonding method. As a result, a resistance reduction portion including the common lead electrode and the connection wire is provided so that a resistance value of the common electrode is substantially reduced when a voltage is applied to the piezoelectric element.

However, in the configuration of Japanese Patent Application Laid-open No. 2004-001366, it is necessary to form the common lead electrode and the bonding wire, and to additionally provide a connection portion on the substrate for connecting the electrode and the wire thereto. Therefore, the area of the droplet discharging head increases, and thus it is difficult to facilitate miniaturization of the droplet discharging head. In addition, there has been a problem in that a production process is made complicated by the connection using the wire bonding.

Therefore, in the related art, it has been difficult to miniaturize the droplet discharging head, to improve the production efficiency, and to suppress the occurrence of the voltage drop.

Thus, there is a need to provide a droplet discharging head and an image forming apparatus capable of allowing the miniaturization of a droplet discharging head, improving the production efficiency, and suppressing the occurrence of the voltage drop.

SUMMARY OF THE INVENTION

It is an object of the present invention to at least partially solve the problems in the conventional technology.

A droplet discharging head includes: a nozzle substrate that includes a nozzle opening configured to discharge a droplet therethrough; a liquid chamber substrate that includes a plurality of liquid pressure chambers communicating respectively with the nozzle openings; a vibration plate arranged to face the nozzle substrate with the liquid chamber substrate interposed therebetween; a plurality of piezoelectric elements that are provided to respectively face the liquid pressure chambers with the vibration plate interposed therebetween and are arranged in a predetermined direction; a driving element provided, in a flip-chip implementation, on a flow path substrate that includes the nozzle substrate, the liquid chamber substrate, the vibration plate, and the piezoelectric elements such that the driving element is bonded to each of the piezoelectric elements; and a first reinforcing wire that is disposed to at least one of the flow path substrate and the driving element, that has a band shape extending in a direction along a row of the piezoelectric elements, and that is connected to a common electrode shared by the piezoelectric elements through at least one connecting position.

A droplet discharging head includes: a nozzle substrate that includes a nozzle opening configured to discharge a droplet; a liquid chamber substrate that includes a plurality of liquid pressure chambers communicating respectively with the nozzle openings; a vibration plate arranged to face the nozzle substrate with the liquid chamber substrate interposed therebetween; a plurality of piezoelectric elements that are provided to respectively face the liquid pressure chambers with the vibration plate interposed therebetween and are arranged in a predetermined direction; a driving element provided, in a flip-chip implementation, on a flow path substrate that includes the nozzle substrate, the liquid chamber substrate, the vibration plate, and the piezoelectric elements such that the driving element is bonded to each of the piezoelectric elements through a protruding electrode for outputting a driving voltage signal to an individual electrode provided in the piezoelectric element; and a second reinforcing wire that is provided in at least one of the flow path substrate and the driving element, has a band shape extending in a direction along a row of the piezoelectric elements, and is electrically connected to the protruding electrode provided in the driving element.

A droplet discharging head includes: a nozzle substrate that includes a plurality of nozzle openings configured to discharge a droplet; a liquid chamber substrate that includes a plurality of liquid pressure chambers communicating respectively with the nozzle openings; a vibration plate provided to face the nozzle substrate with the liquid chamber substrate interposed therebetween; a plurality of piezoelectric elements provided to respectively face the liquid pressure chambers with the vibration plate interposed therebetween and arranged in a predetermined direction; a driving element provided, in a flip-chip implementation, on a flow path substrate that includes the nozzle substrate, the liquid chamber substrate, the vibration plate, and the piezoelectric elements such that the driving element is bonded to each of the piezoelectric elements through a protruding electrode for outputting a driving voltage signal to an individual electrode of the piezoelectric element; a first reinforcing wire that is disposed to at least one of the flow path substrate and the driving element, that has a band shape extending in a direction along a row of the piezoelectric elements, and that is connected to a common electrode shared by the plurality of the piezoelectric elements through at least one connecting position; and a third reinforcing wire that is disposed to at least one of the flow path substrate and the driving element, that has a band shape extending in a direction along a row of the piezoelectric elements, and that is electrically connected to the protruding electrode provided in the driving element.

An image forming apparatus includes the droplet discharging head mentioned above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a droplet discharging head and an image forming apparatus according to embodiments will be described in detail with reference to the accompanying drawings.

First Embodiment

Figure 1:
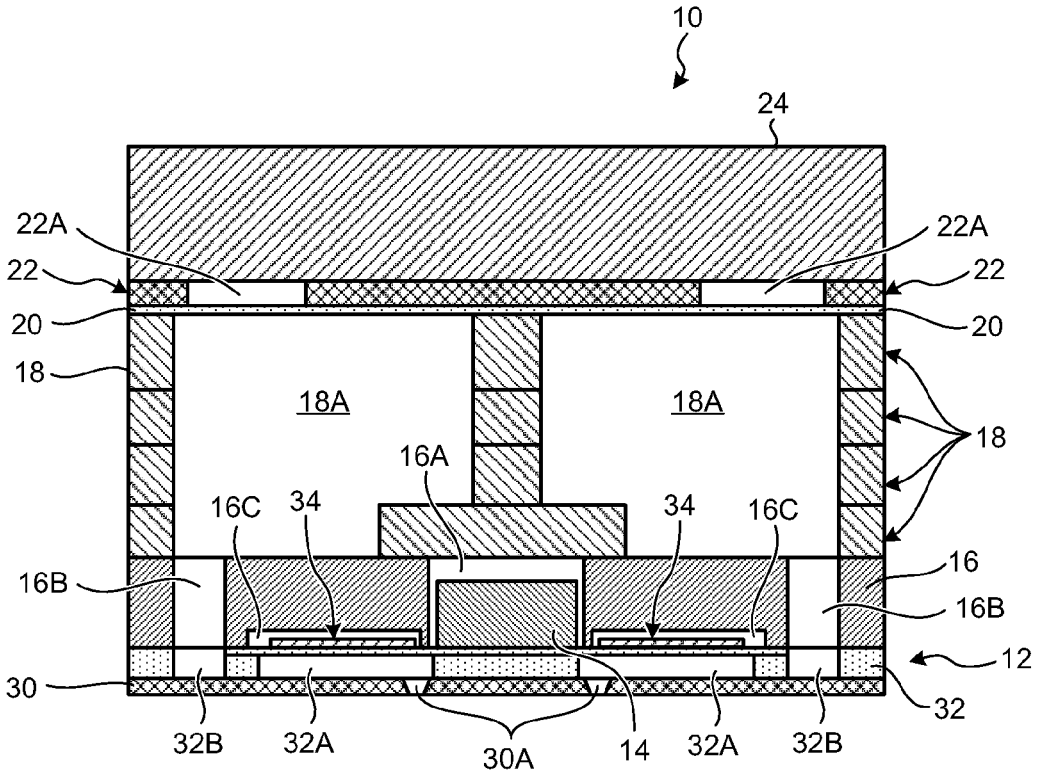
FIG. 1 is an exploded cross-sectional view schematically illustrating a part of a droplet discharging head according to a first embodiment.

As illustrated in FIG. 1, a droplet discharging head 10 according to the embodiment includes a nozzle substrate 30, a liquid chamber substrate 12, a liquid supply substrate 16, a frame substrate 18, a cover plate 24, and a driving element 14. The driving element 14 is provided on the liquid chamber substrate 12 (to be described in detail later) in a flip-chip implementation.

Figure 2:
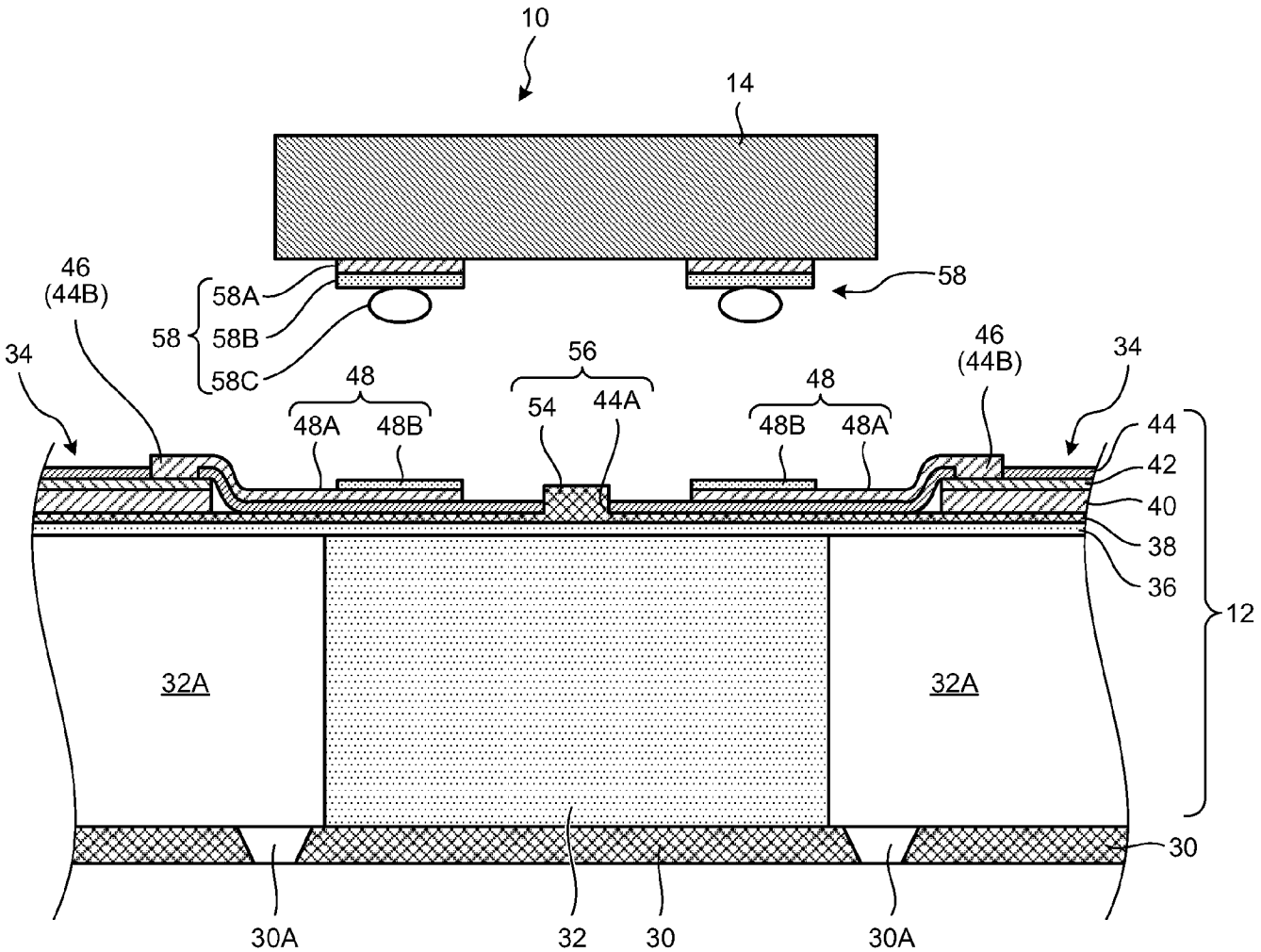
FIG. 2 is an exploded cross-sectional view schematically illustrating a part of the droplet discharging head according to the first embodiment.

The nozzle substrate 30 includes a plurality of nozzle openings 30A for discharging liquid droplets as illustrated in FIGS. 1 and 2. The nozzle openings 30A are through holes passing through the nozzle substrate 30 in the thickness direction, and are arranged across a surface of the nozzle substrate 30.

Figure 3:
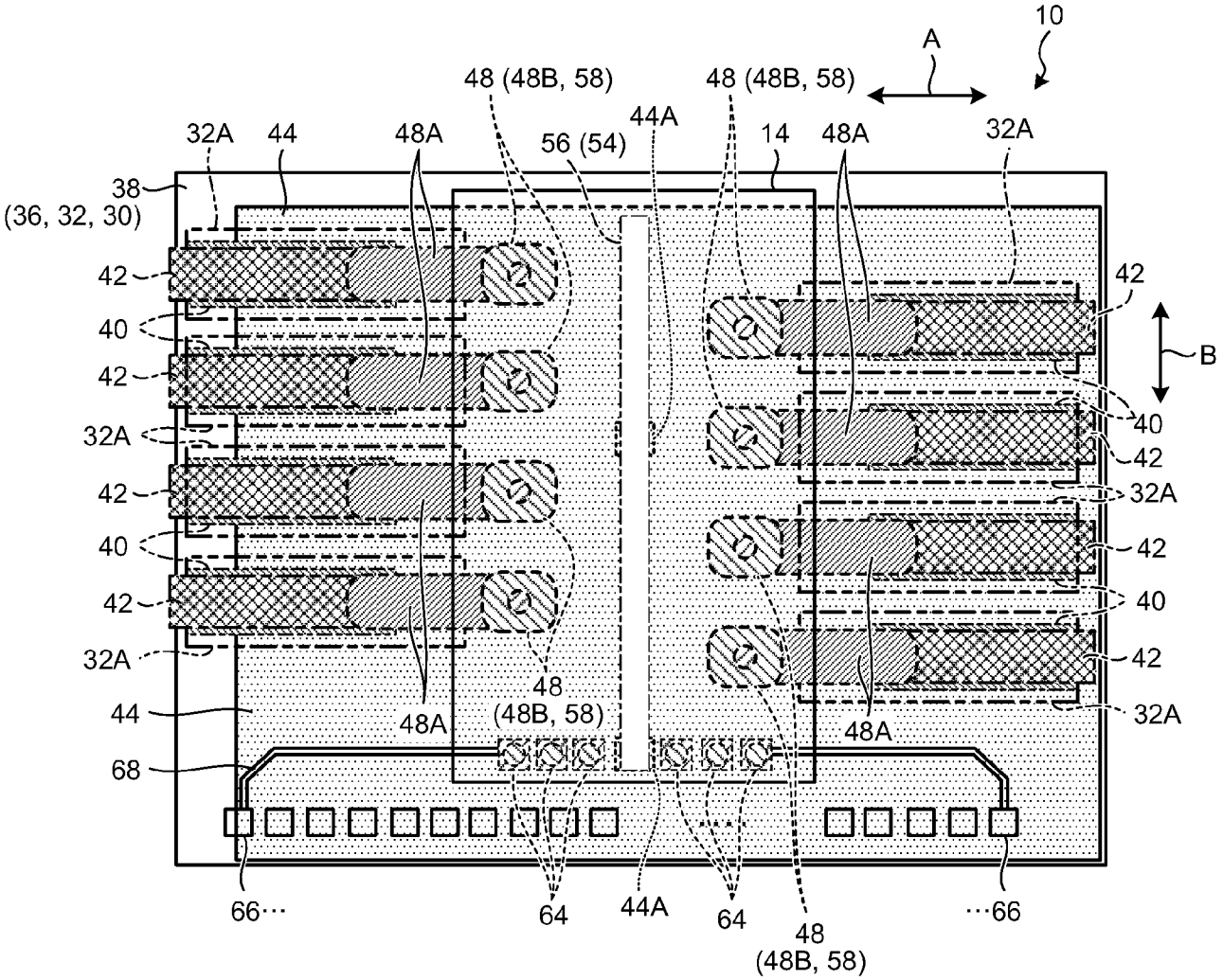
FIG. 3 is a plan view schematically illustrating the droplet discharging head according to the first embodiment.

The liquid chamber substrate 12 includes, as illustrated in FIGS. 2 and 3, a flow path substrate 32, a vibration plate 36, a piezoelectric element 34, an insulating layer 44, an individual electrode 48, and a reinforcing wire 56 (first reinforcing wire).

The liquid supply substrate 16 is disposed to face the nozzle substrate 30 with the liquid chamber substrate 12 interposed therebetween. The liquid supply substrate 16 includes a supply trench 16B communicating with an induction path 32B, an aperture 16A for providing the driving element 14, and a protection space 16C for protecting the piezoelectric element 34. The liquid supply substrate 16 may be formed by a glass substrate or a silicon substrate, for example. In addition, various apertures and trenches of the liquid supply substrate 16 may be formed by etching the substrates described above.

The frame substrate 18 is provided on a surface of the liquid supply substrate 16 on the opposite side of the liquid chamber substrate 12. The frame substrate 18 includes a common liquid chamber 18A shared by respective liquid pressure chambers 32A. The common liquid chamber 18A may be formed, for example, by etching the frame substrate 18. The common liquid chamber 18A communicates with each of the liquid pressure chambers 32A through the supply trench 16B of the liquid supply substrate 16 and the induction path 32B of the liquid chamber substrate 12.

A reinforcing plate 22 having a space 22A and the cover plate 24 are sequentially stacked on a surface of the frame substrate 18 on the opposite side of the liquid supply substrate 16 with a damper film 20 interposed therebetween.

The droplet discharging head 10 according to the embodiment includes the driving element 14 and the first reinforcing wire 56. The driving element 14 is provided on the liquid chamber substrate 12 in a flip-chip implementation. Therefore, the droplet discharging head 10 can be miniaturized, the production efficiency can be improved, and the occurrence of a voltage drop caused by simultaneous driving of the piezoelectric elements 34 can be suppressed.

Hereinafter, a detailed configuration of the liquid chamber substrate 12 and the driving element 14 of the droplet discharging head 10, and an action of the droplet discharging head 10 will be described.

The liquid chamber substrate 12 includes the flow path substrate 32, the vibration plate 36, the piezoelectric element 34, the insulating layer 44, the individual electrode 48, and a reinforcing wire 56 (first reinforcing wire) as described above (with reference to FIGS. 2 and 3).

The flow path substrate 32 includes a plurality of the liquid pressure chambers 32A communicating with the respective nozzle openings 30A. In addition, the flow path substrate 32 includes the liquid pressure chambers 32A arranged in a predetermined direction. In the present embodiment, description will be given of a case where the nozzle openings 30A are arranged in two parallel rows in a predetermined direction (indicated by the arrow A in FIG. 3). Therefore, the liquid pressure chambers 32A communicating with the respective nozzle openings 30A are also described as being arranged in two parallel rows in the predetermined direction. The flow path substrate 32 may be implemented by using a silicon substrate, for example.

The vibration plate 36 is disposed to face the nozzle substrate 30 with the flow path substrate 32 interposed therebetween. In addition, the vibration plate 36 is bonded to an edge surface of the flow path substrate 32 on the side of the vibration plate 36. Therefore, the vibration plate 36 functions as a part of the wall surface of the liquid pressure chamber 32A in the flow path substrate 32. The vibration plate 36 may be formed as a film by sputtering $SiO_2$ and the like onto the flow path substrate 32, for example.

A lower electrode 38 is provided on the surface of the vibration plate 36 on the side opposite of the liquid pressure chamber 32A. A piezoelectric substance 40 and an upper electrode 42 are sequentially stacked in this order on each of areas on the corresponding lower electrodes 38 opposite to the liquid pressure chambers 32A. The laminate structure of the lower electrode 38, the piezoelectric substance 40, and the upper electrode 42 forms the piezoelectric element 34.

The lower electrode 38 may be formed, for example, by sputtering aluminum and the like onto the vibration plate 36. The piezoelectric substance 40 may be formed to have a desired size and shape by forming a film using a constituent material of the piezoelectric substance 40 and patterning the film through a known process of etching and the like.

In the embodiment, as described above, the liquid pressure chambers 32A are arranged in the two parallel rows in the predetermined direction. Therefore, the piezoelectric elements 34 provided to correspond to the liquid pressure chambers 32A are also arranged in two parallel rows in the predetermined direction.

Although description in the embodiment is given of a case in which the positions of the piezoelectric elements 34 in one of the two rows are shifted from the positions of the piezoelectric elements 34 in the other row, so that the piezoelectric elements 34 in the two rows are arranged in the zigzag manner as illustrated in FIG. 3, the embodiment is not limited to such a zigzag-like arrangement.

In the embodiment, it is assumed that the lower electrode 38 is a common electrode shared by the piezoelectric elements 34 (with reference to FIG. 2). In addition, it is assumed that the upper electrode 42 is the individual electrode independently and individually provided for each of the plurality of the piezoelectric elements 34 (with reference to FIG. 2). Therefore, in the embodiment, a description is given with an assumption that the lower electrode 38 is provided to be in continuous contact with all the piezoelectric substances 40 of the plurality of the piezoelectric elements 34 provided in the liquid chamber substrate 12 as illustrated in FIGS. 2 and 3. In the meantime, it is assumed that the upper electrodes 42 are independently provided for the respective piezoelectric elements 34 (piezoelectric substances 40).

The insulating layer 44 is provided on the piezoelectric element 34. More specifically, the insulating layer 44 is provided in a layered structure so as to cover the upper electrode 42 provided on the piezoelectric substance 40 and exposed areas of the lower electrode 38 that are not covered by the upper electrode 42.

Contact holes 44B are provided in the insulating layer 44 in areas above the upper electrodes 42, and end portions 46 of lead wires 48A are bonded to the contact holes 44B. The lead wires 48A are provided on the insulating layer 44 to correspond to the respective piezoelectric elements 34. The lead wire 48A is a wire that extends from an area corresponding to the piezoelectric element 34 in the insulating layer 44 to an area between the two rows of the piezoelectric elements 34. Each of the lead wires 48A are bonded, respectively, to the upper electrodes 42 through the contact holes 44B at the end portions 46 of the lead wires 48A in the extending direction.

A gold plating portion 48B is provided at an end of each of the lead wires 48A on the side opposite to the corresponding piezoelectric element 34. The area having the gold plating portion 48B on the lead wire 48A forms each of the individual electrodes 48 (electrode terminals) for bonding to the driving element 14. Therefore, the individual electrodes 48 are arranged corresponding to the arrangement of the piezoelectric elements 34 as illustrated in FIG. 3. That is, the individual electrodes 48 are arranged in two parallel rows in a predetermined direction (direction indicated by the arrow B in FIG. 3).

As illustrated in FIG. 3, the first reinforcing wire 56 having a band shape extending in a direction along a row of the piezoelectric elements 34 is provided between the two rows of the individual electrodes 48 in the insulating layer 44. The first reinforcing wire 56, as illustrated in FIGS. 2 and 3, includes an aluminum wire 54 having a band shape extending in a direction along a row of the piezoelectric elements 34 and a contact hole 44A electrically connecting the aluminum wire 54 to the lower electrode 38 serving as the common electrode. The aluminum wire 54 (that is, first reinforcing wire 56) is electrically connected (bonded) to the lower electrode 38 through the contact hole 44A with at least one or more connecting portions.

In addition, FIG. 3 illustrates a case where the first reinforcing wire 56 is electrically connected to the lower electrode 38 serving as the common electrode through two of the contact holes 44A. However, the first reinforcing wire 56 may be electrically connected to the lower electrode 38 through one of the contact holes 44A or may be electrically connected to the lower electrode 38 through three or more of the contact holes 44A. Moreover, the first reinforcing wire 56 may be electrically connected to the lower electrode 38 over the entire area of the first reinforcing wire 56 in the extending direction. In this case, the first reinforcing wire 56 is stacked on the lower electrode 38 and the entire area of the first reinforcing wire 56 in the extending direction may be in direct contact with the lower electrode 38.

The driving element 14 is a driving unit for driving each of the piezoelectric elements 34 of the droplet discharging head 10. The driving element 14 is provided on the liquid chamber substrate 12 in a flip-chip implementation and is bonded to the respective piezoelectric elements 34.

In the embodiment, the driving element 14 is arranged to cover an area between the two rows of the piezoelectric elements 34.

More specifically, the driving element 14 includes a plurality of voltage output terminals 58 (protruding electrodes) (also called "bumps") protruding toward the liquid chamber substrate 12. The voltage output terminals 58 are provided at positions to face the respective individual electrodes 48 provided on the liquid chamber substrate 12. Each of the voltage output terminals 58 is a laminated body obtained by sequentially stacking an aluminum pad 58A, a piece of gold plating 58B, and a bump 58C from the main body of the driving element 14.

The voltage output terminals 58 provided in the driving element 14 are bonded to the individual electrodes 48, respectively, on the side of the liquid chamber substrate 12 so that the driving element 14 is provided on the liquid chamber substrate 12 in a flip-chip implementation, and the driving elements 14 are electrically connected to the respective piezoelectric elements 34.

In addition, the voltage output terminals 58 arranged in the two rows in the driving element 14 are formed at both ends of the first reinforcing wire 56 in a direction perpendicular to the longitudinal direction of the first reinforcing wire 56.

Figure 4:
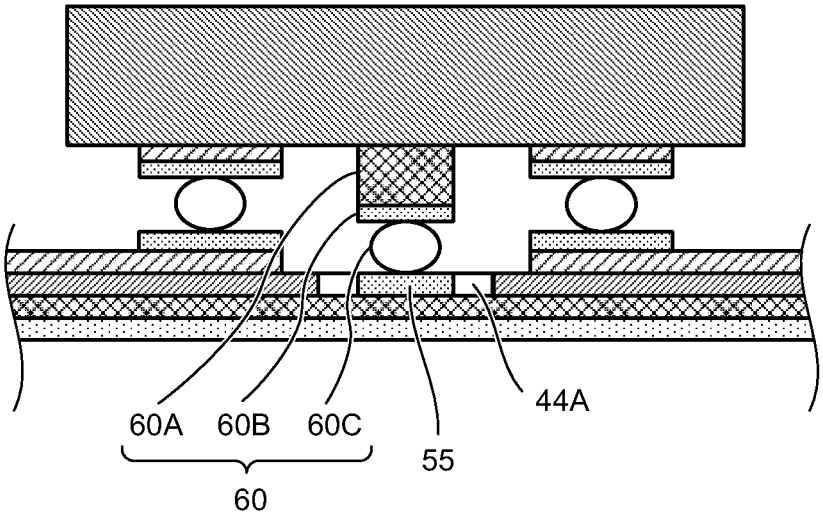
FIG. 4 is an exploded cross-sectional view schematically illustrating a part of the droplet discharging head according to the first embodiment.

Although description has been given of a case where the first reinforcing wire 56 in the example of FIG. 2 is provided in the liquid chamber substrate 12, the first reinforcing wire 56 may be provided in the driving element 14. In this case, for example, as illustrated in FIG. 4, a second reinforcing wire 60 may be provided on the surface of the driving element 14 facing the liquid chamber substrate 12, between two rows along which the voltage output terminals 58 are arranged. The second reinforcing wire 60 may be a laminated body, for example, obtained by sequentially stacking an aluminum wire 60A, a piece of gold plating 60B, and a bump 60C from the side of the driving element 14. On the side of the liquid chamber substrate 12, one or more of the contact holes 44A are provided in the insulating layer 44, and the second reinforcing wire 60 may be electrically connected to the lower electrode 38 through the contact holes 44A.

The driving element 14 includes a plurality of external input terminals 64 for electrically connecting to an external device (not illustrated). Each of the external input terminals 64 is electrically connected to an external connection terminal 66 provided in the droplet discharging head 10 through a wire such as an input wire 68.

The droplet discharging head 10 configured as described above may be manufactured, for example, through the following process.

First, the vibration plate 36, the piezoelectric elements 34, the insulating layer 44, the lead wires 48A, the individual electrodes 48, and the first reinforcing wire 56 are provided on the flow path substrate 32 on which the ink tanks such as the liquid pressure chambers 32A have not yet been formed. Next, the liquid supply substrate 16 is bonded to the flow path substrate 32, and then the driving element 14 is inserted through the aperture 16A of the liquid supply substrate 16 and bonded to the liquid chamber substrate 12 using the flip-chip method. In addition, the junction and surroundings of the driving element 14 may be hermetically sealed by an underfill material so that the driving element 14 is firmly fixed to the liquid chamber substrate 12.

Next, the aperture 16A is hermetically sealed by a sealing material. In the flow path substrate 32 in which the liquid chambers have not yet been formed, a surface of the flow path substrate 32 that is opposite to the surface on which the piezoelectric elements 34 and the like have been formed is ground to decrease the thickness to have a predetermined thickness by polishing. The thickness of the flow path substrate 32 is adjusted according to the arrangement density of the piezoelectric elements 34. For example, when the piezoelectric elements 34 are provided with a density of 300 dpi/line, it is preferable that the thickness of the flow path substrate 32 be equal to or less than 100 μm.

Next, the liquid pressure chambers 32A, the induction path 32B, and a fluid resistance portion (not illustrated) and the like are formed in the polished flow path substrate 32 through etching. In addition, the fluid resistance portion (not illustrated) is formed so as to have a smaller width than each of the liquid pressure chambers 32A so that the liquid pressure chambers 32A and the induction path 32B can communicate with each other and the fluid resistance portion can function as the fluid resistance.

Then, the droplet discharging head 10 is manufactured by bonding the flow path substrate 32 to the nozzle substrate 30 and further by sequentially providing the frame substrate 18, the damper film 20, the reinforcing plate 22, and the cover plate 24 on the liquid supply substrate 16.

In the droplet discharging head 10 configured as described above, the driving signal for driving each of the piezoelectric elements 34 is input into the driving element 14 through the external connection terminal 66 and the input wire 68. The driving signal is a signal that indicates the value of a voltage applied to each of the piezoelectric elements 34 and a voltage applying time for each of the piezoelectric element 34 or the like. When the driving signal is input into the driving element 14, the driving element 14 selectively outputs the driving voltage signal showing a waveform having a voltage value and a pulse width corresponding to the input driving signal, to the voltage output terminal 58 bonded to the individual electrode 48 that is connected to the piezoelectric element 34 serving as a liquid discharging target.

In the voltage output terminal 58 into which the driving voltage signal is input, the voltage having a voltage value and an applied period according to the input driving voltage signal is applied, and the piezoelectric elements 34 connected to the voltage output terminals 58 are selectively driven. More specifically, the voltage corresponding to the input driving voltage signal is applied between the upper electrode 42 and the lower electrode 38 of the piezoelectric element 34 that is the liquid discharging target, and a distortion occurs in the piezoelectric substance 40 between these electrodes. As a result, the ink in the liquid pressure chamber 32A corresponding to the driven piezoelectric element 34 can be discharged from the nozzle opening 30A of the liquid pressure chamber 32A.

In the droplet discharging head 10 according to the embodiment configured as described above, the first reinforcing wire 56 or the second reinforcing wire 60 is located in a space (between rows of a plurality of voltage output terminals 58) formed between the liquid chamber substrate 12 and the implemented driving element 14.

Therefore, in the droplet discharging head 10 according to the embodiment, the space made by implementing the driving element 14 may be effectively used as an area to provide the reinforcing wire (the first reinforcing wire 56 or the second reinforcing wire 60). Therefore, the driving element 14 and the droplet discharging head 10 can be miniaturized. In addition, the number of chips available from a wafer for use in forming the droplet discharging heads 10 may be increased.

In the embodiment, as described above, the first reinforcing wire 56 having the band shape extending in a direction along a row of the piezoelectric elements 34 is electrically connected to the lower electrode 38 serving as the common electrode of the piezoelectric elements 34 through the contact holes 44A. Therefore, the first reinforcing wire 56 functions as a resistance reducer of the lower electrode 38 serving as the common electrode.

Here, the lower electrode 38 being stacked on the vibration plate 36 plays the role of a vibration plate. Therefore, it is considered that the discharging characteristics decrease as the thickness of the lower electrode 38 increases. Moreover, as the thickness of the lower electrode 38 increases, the manufacturing cost increases because the time required for a film formation increases. Therefore, it is difficult to thicken the lower electrode 38 due to the degraded discharging characteristics and the increasing manufacturing cost.

On the contrary, in the droplet discharging head 10 according to the embodiment, as described above, the first reinforcing wire 56 functions as the resistance reducer of the lower electrode 38 serving as the common electrode, so that the resistance value of the lower electrode 38 when the voltage is applied to each of the piezoelectric elements 34 can be substantially reduced without increasing the thickness of the lower electrode 38.

Therefore, according to the present embodiment, the droplet discharging head 10 can be implemented in a small size, the production efficiency can be improved, and the occurrence of a voltage drop caused by simultaneous driving of the piezoelectric elements 34 can be suppressed.

The driving element 14 is bonded to the piezoelectric elements 34 using the flip-chip method, so that the production efficiency can be improved. The driving element 14 for driving the piezoelectric elements 34 is bonded to the piezoelectric elements 34 using the flip-chip method, so that shorting out of a circuit caused by the contact between wires may be prevented compared to the case where the driving element 14 is implemented using the wire bonding method.

In the present embodiment, description has been given of a case where the lower electrode 38 is the common electrode, and the upper electrode 42 is an individual electrode. However, the configuration may be reversed depending on convenience of the wiring. That is, the lower electrode 38 may be the individual electrode, and the upper electrode 42 may be the common electrode. In this case, the first reinforcing wire 56 and the second reinforcing wire 60 described above may be electrically connected to the upper electrode 42 serving as a common electrode.

In the present embodiment, description has been given of a case where the piezoelectric elements 34 are arranged in two parallel rows in a predetermined direction. However, the embodiment is not limited thereto, that is, because, the piezoelectric elements 34 are arranged in a predetermined direction in the droplet discharging head 10 according to the embodiment, the first reinforcing wire 56 having a band shape extending in a direction along a row of the piezoelectric elements 34 may be provided in any one of the liquid chamber substrate 12 and the driving element 14.

However, from the viewpoint of further miniaturization of the droplet discharging head 10, as described above, it is preferable to arrange the piezoelectric elements 34 in two parallel rows in a predetermined direction and to provide the driving element 14 to cover the area between the rows.

The number of rows of the piezoelectric elements 34 is not limited to two, but may be four or more, for example. In addition, in a case where four rows of piezoelectric elements 34 are arranged, the first reinforcing wire 56 may be provided between two rows of individual electrodes 48 for every two rows of the piezoelectric elements 34, and the driving element 14 may be provided to cover the area between the rows so as to allow a flip chip bonding structure.

In the present embodiment, as illustrated in FIG. 3, description has been given of a case where the positions of the piezoelectric elements 34 on one of the respective rows are arranged to be deviated from the positions of the corresponding piezoelectric elements 34 on the other row to thereby form a zigzag shape. However, the arrangement of the piezoelectric elements 34 on the respective rows is not limited to the zigzag shape. However, the zigzag arrangement of the plurality of the piezoelectric elements 34 is preferable in terms of miniaturization of the droplet discharging head 10.

Second Embodiment

In the first embodiment described above, description has been given of a case where the first reinforcing wire 56 is bonded to the lower electrode 38 which is the common electrode of the piezoelectric element 34.

In the present embodiment, description will be given of a case where a wire corresponding to a first reinforcing wire 56 is electrically connected (bonded) to a voltage output terminal 58 for outputting the driving voltage signal to an individual electrode 48 connected to an upper electrode 42 that is an individual electrode provided in a piezoelectric element 34.

A droplet discharging head 10A according to the embodiment includes the nozzle substrate 30, a liquid chamber substrate 12A, the liquid supply substrate 16, the frame substrate 18, the cover plate 24, and a driving element 14A.

Figure 5:
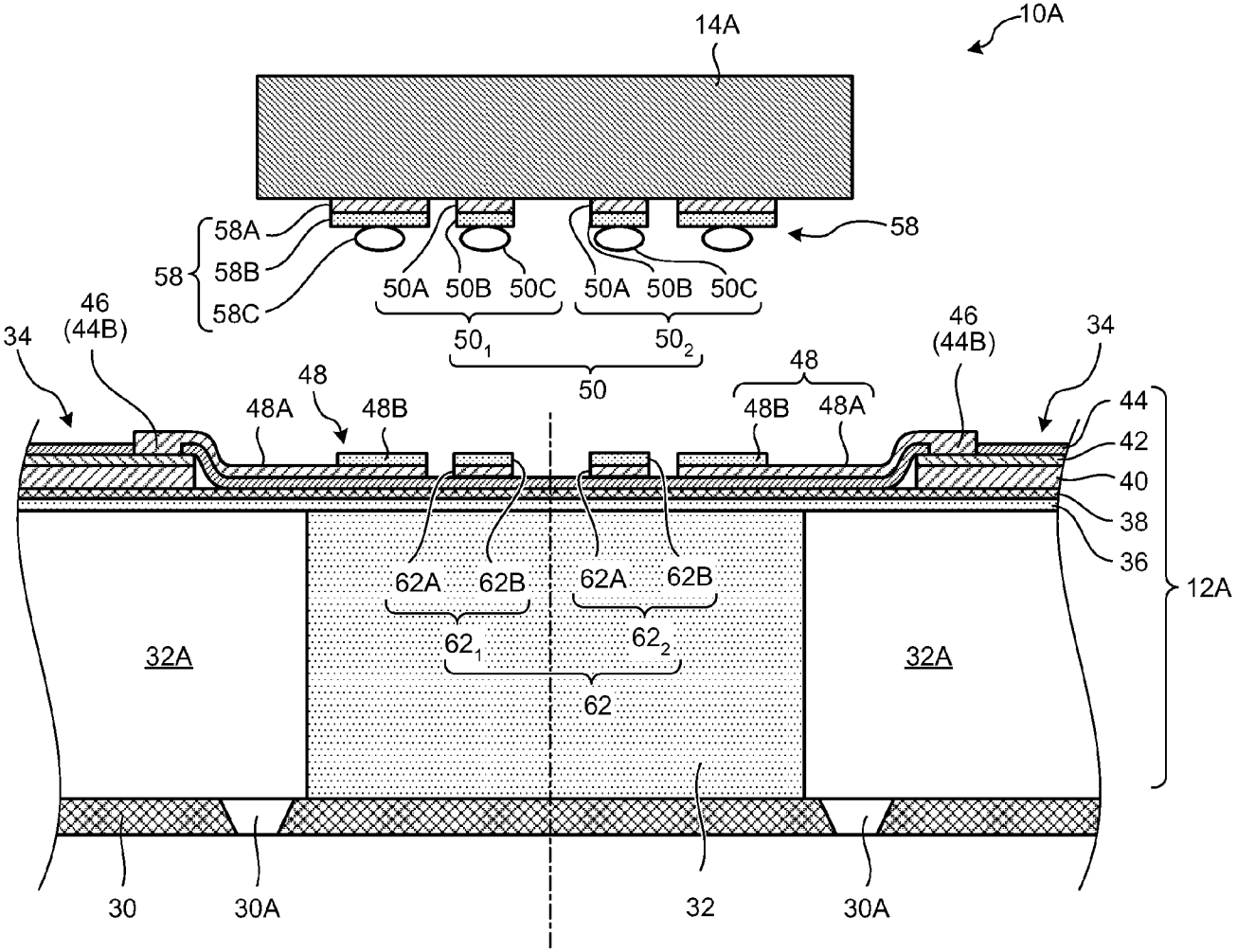
FIG. 5 is an exploded cross-sectional view schematically illustrating a part of a droplet discharging head according to a second embodiment.
Figure 6:
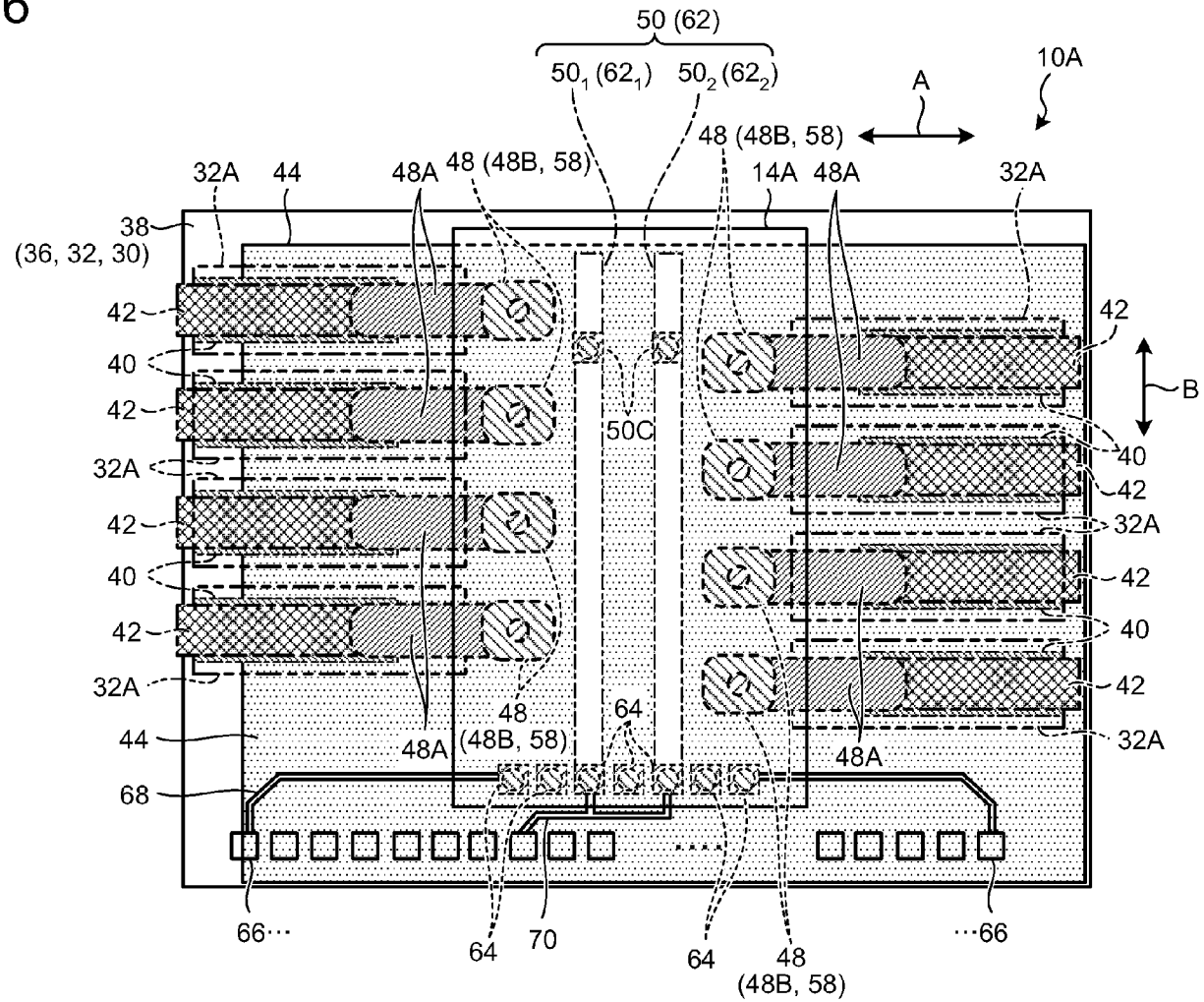
FIG. 6 is a plan view schematically illustrating the droplet discharging head according to the second embodiment.

The liquid chamber substrate 12A includes, as illustrated in FIGS. 5 and 6, the flow path substrate 32, the vibration plate 36, the piezoelectric element 34, the insulating layer 44, the individual electrode 48 and a voltage supply wire 62 (second reinforcing wire).

The configuration of the droplet discharging head 10A of the embodiment is similar to that of the droplet discharging head 10 except that the liquid chamber substrate 12 of the droplet discharging head 10 described in the first embodiment is substituted with the liquid chamber substrate 12A, and the driving element 14 of the first embodiment is substituted with the driving element 14A. In addition, the configuration of the liquid chamber substrate 12A of the droplet discharging head 10A of the present embodiment is similar to that of the liquid chamber substrate 12 of the first embodiment except that the first reinforcing wire 56 of the liquid chamber substrate 12 is substituted with the voltage supply wire 62. In addition, the configuration of the driving element 14A of the present embodiment is similar to the configuration of the driving element 14 except that a voltage supply electrode 50 (with reference to FIG. 5) to be described below is further provided. Therefore, the elements having the same configurations and the same functions as the droplet discharging head 10 of the first embodiment will be denoted with the same reference numerals, and the description thereof will not be repeated.

The driving element 14A is a driving unit for driving each of the piezoelectric elements 34 of the droplet discharging head 10A. The driving element 14A is provided on the liquid chamber substrate 12A in a flip-chip implementation and is bonded to the respective piezoelectric elements 34.

Specifically, the driving element 14A is arranged to cover an area between two rows of the piezoelectric elements 34 arranged in rows. More specifically, the driving element 14A includes a plurality of the voltage output terminals 58 protruding toward the liquid chamber substrate 12A. The voltage output terminals 58 are provided at locations to face the respective individual electrodes 48 provided on the liquid chamber substrate 12A. Therefore, two rows of the voltage output terminals 58 are provided in the driving element 14A along the arrangement of the piezoelectric elements 34.

The voltage supply electrodes 50 having a band shape extending in a direction along a row of the piezoelectric elements 34 are arranged in two parallel rows between two rows of the voltage output terminals 58 on the surface facing the liquid chamber substrate 12A of the driving element 14A (with reference to FIGS. 5 and 6). That is, a voltage supply electrode $\mathbf{50}_1$ and a voltage supply electrode $\mathbf{50}_2$ having a band shape extending in a direction along a row of the piezoelectric elements 34 are arranged between the two rows of the voltage output terminals 58. In addition, the voltage supply electrode $\mathbf{50}_1$ and the voltage supply electrode $\mathbf{50}_2$ may be collectively called voltage supply electrodes 50 for simplicity.

Inside the driving element 14A, each of the voltage supply electrodes 50 is connected to the voltage supply line (also, referred to as a Vcom line) provided in the driving element 14A through a wire (not illustrated) (this configuration is not illustrated in the figure). In addition, one end of each of the voltage supply electrodes 50 in the longitudinal direction is connected to an external connection terminal 66 through an input wire 70.

As illustrated in FIG. 5, each of the voltage supply electrode 50 has a laminated body obtained by sequentially stacking gold plating 50B and a bump 50C on an aluminum wire 50A.

On the insulating layer 44 provided in the liquid chamber substrate 12A, voltage supply wires $\mathbf{62}_1$ and $\mathbf{62}_2$ are provided in the respective areas to face the voltage supply electrodes $\mathbf{50}_1$ and $\mathbf{50}_2$ in the driving element 14A. In addition, the voltage supply wires $\mathbf{62}_1$ and $\mathbf{62}_2$ are collectively called the "voltage supply wire 62" for simplicity.

The voltage supply wire 62 is a laminated body obtained by sequentially stacking an aluminum wire 62A and gold plating 62B on the insulating layer 44. In the present embodiment, description will be given of a case where the voltage supply wires $\mathbf{62}_1$ and $\mathbf{62}_2$ are provided in a band shape on the entire area facing the respective voltage supply electrodes $\mathbf{50}_1$ and $\mathbf{50}_2$ in the driving element 14A. However, the embodiment may be accomplished if at least one of the voltage supply electrodes 50 (the voltage supply electrodes $\mathbf{50}_1$ and $\mathbf{50}_2$) and the voltage supply wires 62 (the voltage supply wires $\mathbf{62}_1$ and $\mathbf{62}_2$) is provided in a band shape extending in a direction along a row of the piezoelectric elements 34, and if each of the voltage supply electrodes 50 and the voltage supply wires 62 are bonded at one or more positions via the bumps 50C. For example, at least one of a plurality of the voltage supply electrodes 50 and a plurality of the voltage supply wires 62 may be configured to be in a dotted distribution by keeping predetermined intervals in a direction along a row of the piezoelectric elements 34.

The voltage supply electrodes 50 and the voltage supply wires 62 may be electrically connected over the entire area in an extending direction thereof (arranged in a contact manner).

Each of the voltage supply electrodes 50 and each of the voltage supply wires 62 may be bonded to each other in at least one or more positions through the bumps 50C, that is, the embodiment is not limited to the configuration in which the voltage supply electrodes 50 and the voltage supply wires 62 are bonded over the entire area.

The description in the embodiment has been given of a case where the voltage supply electrodes 50 are provided in the driving element 14A of the droplet discharging head 10A, and the voltage supply wires 62 are provided on the side of the liquid chamber substrate 12A in the area opposite to the voltage supply electrodes 50. However, the configuration may not include the voltage supply wire 62. In particular, when the aluminum wires 50A of the voltage supply electrodes 50 exhibit a performance enough to reduce the wiring resistance, the voltage supply wires 62 may not be provided.

In the droplet discharging head 10A configured as described above, the driving signal for driving each of the piezoelectric elements 34 is input into the driving element 14A through the external connection terminal 66 and the input wire 68. The driving signal is a driving waveform indicating the voltage value applied to each of the piezoelectric elements 34 and the voltage applying period for each of the piezoelectric element 34 or the like.

In the droplet discharging head 10A, the signal indicating the driving voltage to be applied to each of the piezoelectric elements 34 is input to the voltage supply electrodes 50 (the voltage supply electrodes $\mathbf{50}_1$ and $\mathbf{50}_2$) through the input wire 70 from the external connection terminal 66. Therefore, the signal waveform having the same waveform indicating the voltage value applied to each of the piezoelectric elements 34 is input to the voltage supply electrodes 50 (the voltage supply electrodes $\mathbf{50}_1$ and $\mathbf{50}_2$). That is, the signal waveform indicating the same voltage value is supplied to the voltage supply electrodes 50 over a range from one end to the other end of the voltage supply electrodes 50 in the longitudinal direction.

The driving element 14A selectively outputs the driving voltage signal to the voltage output terminal 58 with a pulse width depending on the driving signal having been input through the input wire 68 and a voltage value depending on the signal waveform having been input to the voltage supply electrodes 50.

Therefore, the voltage, having the voltage value and the applying period depending on the input driving voltage signal, is applied to the voltage output terminal 58 into which the driving voltage signal has been input, and the piezoelectric element 34 connected to the voltage output terminal 58 is selectively driven.

In the droplet discharging head 10A according to the embodiment, as described above, the voltage supply electrodes 50 (the voltage supply electrodes $\mathbf{50}_1$ and $\mathbf{50}_2$) and the voltage supply wires 62 (the voltage supply wires $\mathbf{62}_1$ and $\mathbf{62}_2$) are positioned in a space, formed by implementing the driving element 14A, between the driving element 14A and the liquid chamber substrate 12A (between rows of the plurality of the voltage output terminals 58). Therefore, in the embodiment, the space formed by implementing the driving element 14A can be effectively used for an area in which the wires (the voltage supply electrodes 50 and the voltage supply wires 62) are provided. Accordingly, the driving element 14A and the droplet discharging head 10A can be miniaturized. In addition, the number of chips available from a wafer for use in forming the respective droplet discharging heads 10A can be increased.

In the droplet discharging head 10A according to the embodiment, the voltage supply electrode 50 is provided in the driving element 14A, and the voltage supply electrode 50 is connected to the voltage output terminal 58 inside the driving element 14A.

Therefore, the driving voltage signal indicating a voltage value to be applied to the piezoelectric elements 34 is input to the voltage supply electrode 50. Accordingly, a signal having a pulse width depending on the driving signal for driving each of the piezoelectric elements 34 and a voltage value depending on the driving voltage signal can be supplied to each of the piezoelectric elements 34. That is, the voltage supply electrode 50 functions as reinforcing wires for preventing the driving voltage applied to each of the individual electrodes 48 from dropping. Therefore, the voltage drop of the driving voltage applied to the piezoelectric elements 34 can be suppressed.

In the droplet discharging head 10A according to the embodiment, the droplet discharging head 10A can be miniaturized, the production efficiency can be improved, and the occurrence of a voltage drop caused by simultaneous driving of the piezoelectric elements 34 can be suppressed.

Third Embodiment

In the first embodiment, the description has been given of a case where the first reinforcing wire 56 is provided and the first reinforcing wire 56 is bonded to the lower electrode 38 serving as a common electrode for the piezoelectric elements 34. In addition, in the second embodiment, the description has been given of a case where the voltage supply electrode 50 is provided and the voltage supply electrode 50 is connected to the voltage output terminal 58.

Meanwhile, according to the present embodiment, description will be given of a configuration that includes both the first reinforcing wire 56 of the first embodiment and the voltage supply electrode 50 of the second embodiment.

A droplet discharging head 10B of the embodiment includes a nozzle substrate 30, a liquid chamber substrate 12B, a liquid supply substrate 16, a frame substrate 18, a cover plate 24, and a driving element 14B.

Figure 7:
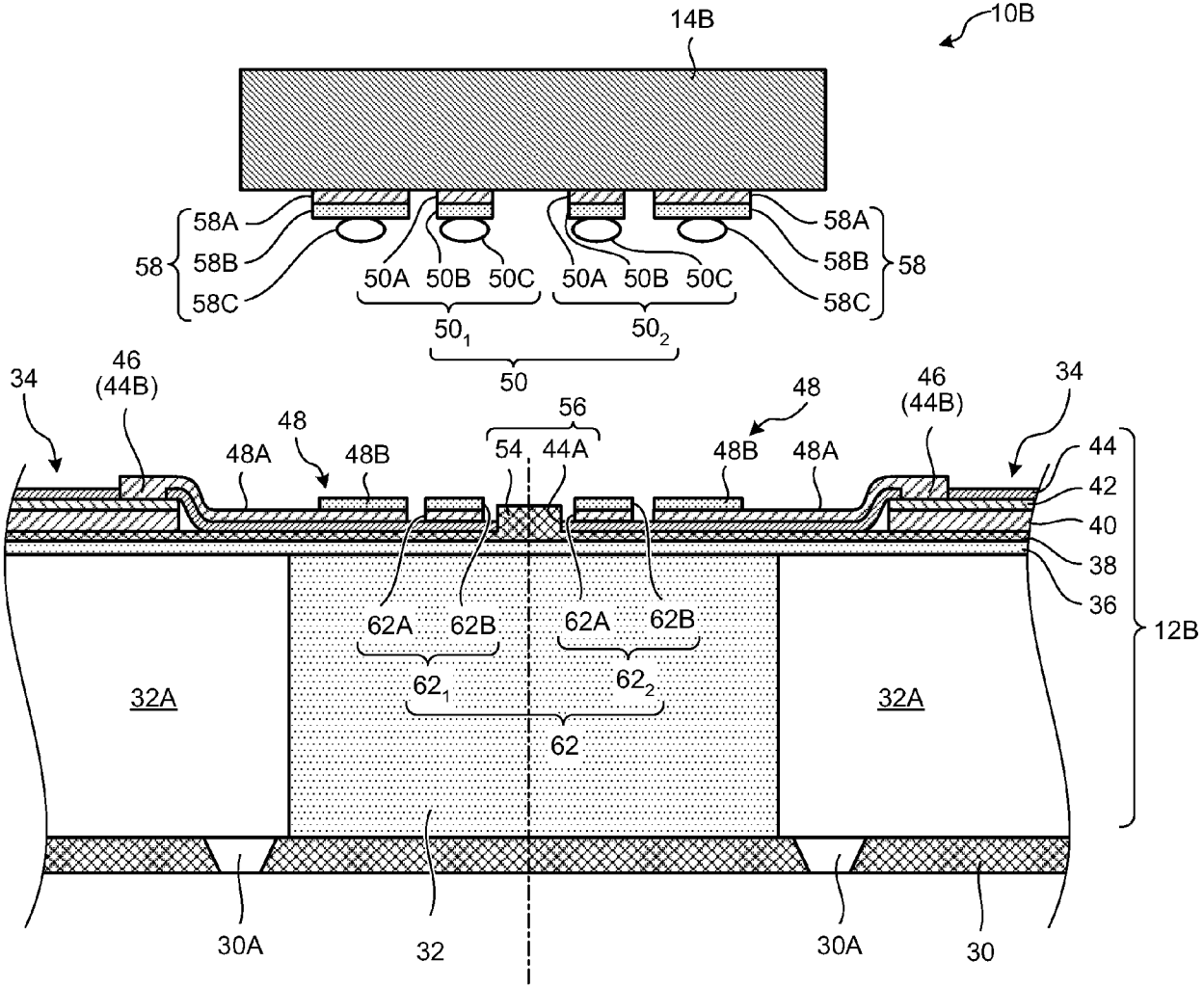
FIG. 7 is an exploded cross-sectional view schematically illustrating a part of a droplet discharging head according to a third embodiment.
Figure 8:
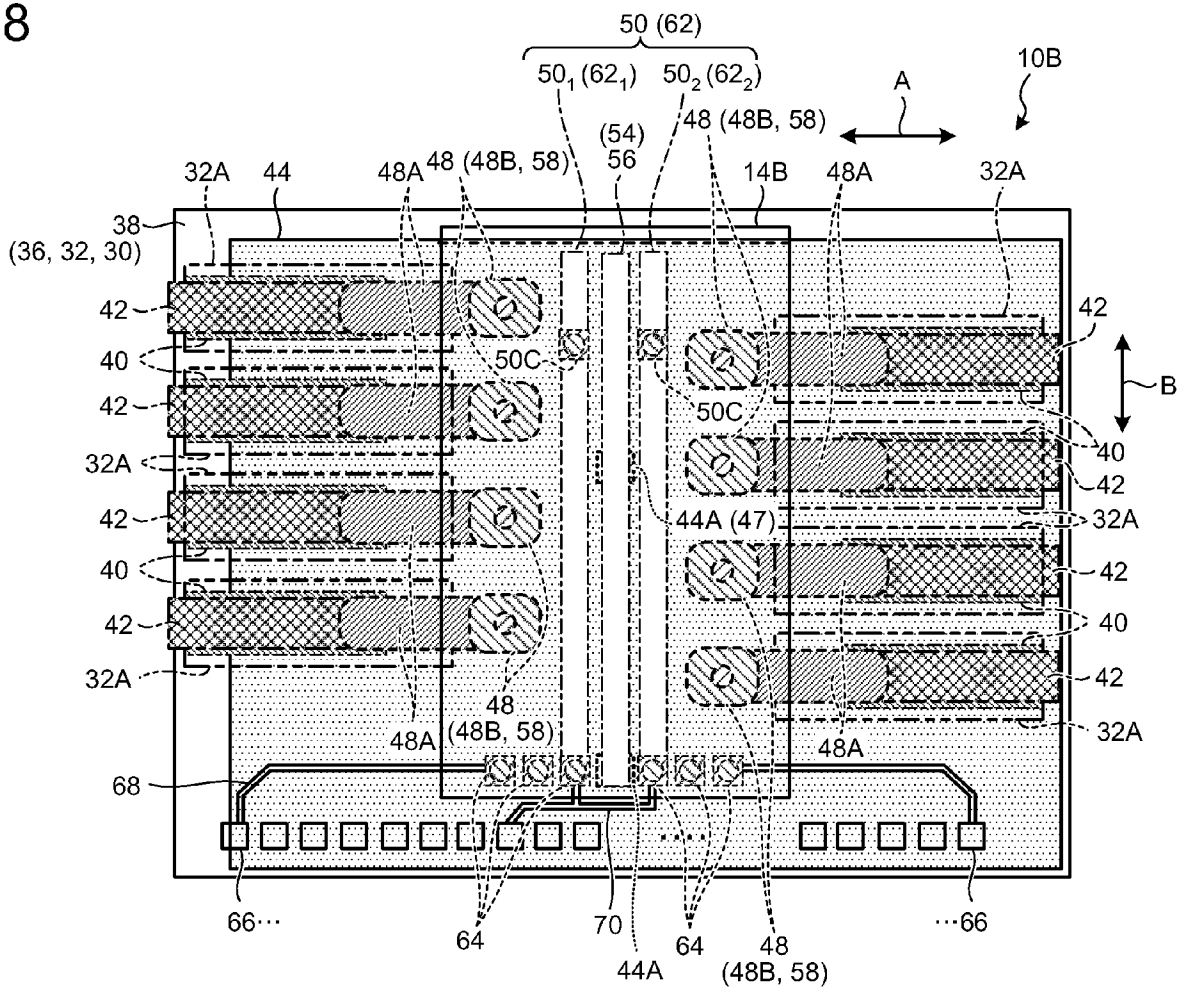
FIG. 8 is a plan view schematically illustrating the droplet discharging head according to the third embodiment.

As illustrated in FIGS. 7 and 8, the liquid chamber substrate 12B includes a flow path substrate 32, a vibration plate 36, a piezoelectric element 34, an insulating layer 44, an individual electrode 48, a first reinforcing wire 56 (first reinforcing wire), and a voltage supply wire 62 (second reinforcing wire).

The droplet discharging head 10B of the present embodiment has the same configuration as that of the droplet discharging head 10A of the second embodiment except that the liquid chamber substrate 12B having a configuration including the first reinforcing wire 56 of the first embodiment is provided instead of the liquid chamber substrate 12A in the droplet discharging head 10A of the second embodiment. Therefore, the elements having the same configurations and the same functions as the droplet discharging head 10 of the first embodiment and the droplet discharging head 10A of the second embodiment will be denoted by the same reference numerals, and the description thereof will not be repeated.

As illustrated in FIGS. 7 and 8, the liquid chamber substrate 12B of the droplet discharging head 10B according to the embodiment includes the flow path substrate 32, the vibration plate 36, the piezoelectric element 34, the insulating layer 44, the individual electrode 48, the reinforcing wire 56 (first reinforcing wire), and the voltage supply wire 62.

The first reinforcing wire 56 is provided between two rows of the individual electrodes 48 of the insulating layer 44 and has a band shape extending in a direction along a row of the piezoelectric elements 34. On the insulating layer 44 provided on the liquid chamber substrate 12B, voltage supply wires $\mathbf{62}_1$ and $\mathbf{62}_2$ are provided in areas corresponding to voltage supply electrodes $\mathbf{50}_1$ and $\mathbf{50}_2$ of a driving element 14B, respectively.

The first reinforcing wire 56, the voltage supply electrode $\mathbf{50}_1$ (the voltage supply wire $\mathbf{62}_1$), and the voltage supply electrode $\mathbf{50}_2$ (the voltage supply wire $\mathbf{62}_2$) are provided in parallel in an area between rows of the individual electrodes 48 that are arranged to form two rows.

In the droplet discharging head 10B of the embodiment, the first reinforcing wire 56, the voltage supply electrode 50 (the voltage supply electrodes $\mathbf{50}_1$ and $\mathbf{50}_2$), and the voltage supply wire 62 (the voltage supply wires $\mathbf{62}_1$ and $\mathbf{62}_2$) are positioned in a space (between the rows of the plurality of the voltage output terminals 58) formed between the driving element 14B and the liquid chamber substrate 12B by implementing the driving element 14B as described above. Thus, according to the embodiment, the space generated by implementing the driving element 14B can be effectively used as an area in which wires (the first reinforcing wire 56, the voltage supply electrode 50, and the voltage supply wire 62) are provided, so that the driving element 14B and the droplet discharging head 10B can be miniaturized. In addition, the number of chips available from a wafer for use in forming the droplet discharging heads 10B may be increased.

In the droplet discharging head 10B configured as described above, a driving signal for driving each of the piezoelectric elements 34 is input into the driving element 14B through the external connection terminal 66 and the input wire 68. This driving signal is a driving waveform representing a voltage value of a voltage applied to each of the piezoelectric elements 34 and a voltage applying period to each of the piezoelectric elements 34.

In addition, in the droplet discharging head 10B, the signal indicating the driving voltage applied to the piezoelectric element 34 is input to the voltage supply electrode 50 (the voltage supply electrodes $\mathbf{50}_1$ and $\mathbf{50}_2$) through the input wire 70 from the external connection terminal 66. Therefore, a signal waveform having the same waveform indicating a voltage value applied to each of the piezoelectric elements 34 is input to the voltage supply electrode 50 (voltage supply electrodes $\mathbf{50}_1$ and $\mathbf{50}_2$). That is, a signal waveform indicating the same voltage value is supplied over a range from one end of the longitudinal direction of the voltage supply electrode 50 to the other end thereof.

In addition, in the driving element 14B, a driving voltage signal having a pulse width depending on the driving signal input through the input wire 68 and a voltage value depending on the signal waveform input to the voltage supply electrode 50 is selectively output to the voltage output terminal 58 bonded to the piezoelectric element 34 that is a target for discharging an ink droplet through the individual electrode 48.

Therefore, a voltage having a voltage value and an applying period corresponding to the input driving voltage signal is applied to the voltage output terminal 58 into which the driving voltage signal is input, so that the piezoelectric element 34 connected to the voltage output terminal 58 is selectively driven. Therefore, even when a plurality of piezoelectric elements 34 are simultaneously driven, a voltage drop caused by the decrease of the applied voltage associated with an increase in the distance from the external input terminal 64 may be suppressed.

In addition, as described above, the first reinforcing wire 56 having a band shape extending in a direction along a row of the piezoelectric elements 34 is electrically connected to the lower electrode 38 serving as the common electrode for the piezoelectric element 34 through the contact hole 44A.

Therefore, the resistance value of the lower electrode 38 can be reduced without increasing the thickness of the entire lower electrode 38 serving as the common electrode and also without increasing the area. In addition, even when the plurality of the piezoelectric elements 34 are simultaneously driven, a voltage drop that is a decrease of the applied voltage associated with an increase in the distance from the external input terminal 64 may be suppressed.

Therefore, in the droplet discharging head 10B according to the embodiment, the droplet discharging head 10B may be miniaturized, the production efficiency can be improved, and the occurrence of a voltage drop caused by simultaneous driving of the piezoelectric elements 34 can be suppressed.

In the first to third embodiments, as an example of the droplet discharging head, the droplet discharging head 10, the droplet discharging head 10A, and the droplet discharging head 10B for discharging ink droplets have been described. However, the droplet discharging head of the present embodiment is not limited to the droplet discharging head for discharging ink droplets. For example, the droplet discharging head may be a droplet discharging head for discharging a liquid resist as a droplet or a droplet discharging head for discharging a sample, such as DNA, as a droplet.

Fourth Embodiment

Each of the droplet discharging head 10, the droplet discharging head 10A, and the droplet discharging head 10B described in the first to third embodiments may be employed in an image forming apparatus such as a droplet discharging device. Hereinafter, a configuration of a droplet discharging device as an example of the image forming apparatus will be described.

Figure 9:
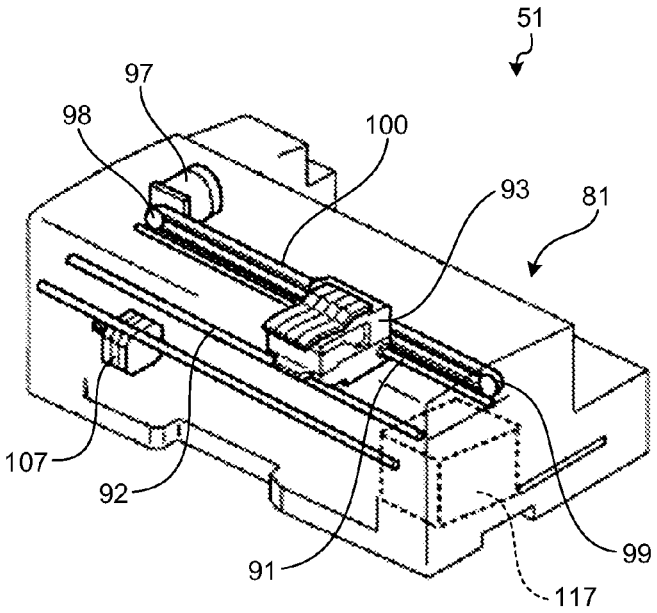
FIG. 9 is a perspective view schematically illustrating a droplet discharging device provided with the droplet discharging head according to any one of the first to third embodiments.
Figure 10:
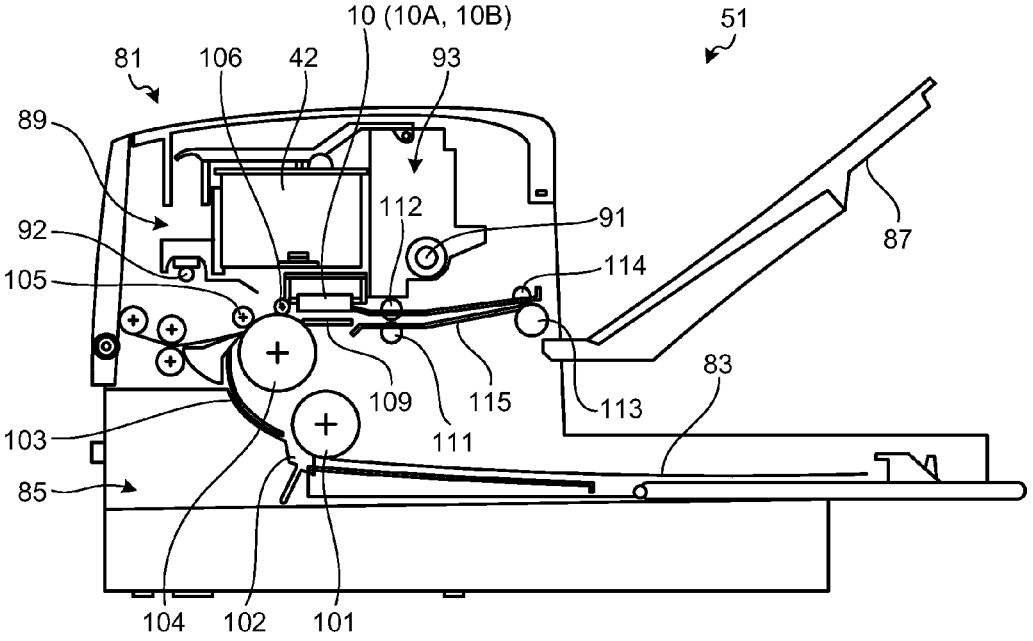
FIG. 10 is a cross-sectional view schematically illustrating the droplet discharging device provided with the droplet discharging head according to any one of the first to third embodiments.

In FIGS. 9 and 10, an exemplary droplet discharging device 51 obtained by employing the droplet discharging head 10A, or the droplet discharging head 10B is illustrated.

As illustrated in FIGS. 9 and 10, the droplet discharging device 51 houses, inside a recording apparatus body 81, a print mechanism unit 89 including a carriage 93 movable in the main-scanning direction, the droplet discharging head 10, the droplet discharging head 10A, or the droplet discharging head 10B mounted on the carriage 93 as described in the first to third embodiments, and an ink tank 43 for supplying ink to the droplet discharging head 10, the droplet discharging head 10A, or the droplet discharging head 10B. A paper cassette 85 (or a paper feed tray) capable of loading a plurality of sheets 83 from the front side may be detachably installed in the lower portion of the recording apparatus body 81. In addition, a bypass tray (not illustrated) for manually feeding the sheets 83 may be installed in the lower portion of the recording apparatus body 81. In the droplet discharging device 51, the sheet 83 is fed from the paper cassette 85 or the bypass tray (not illustrated), a desired image is recorded on the sheet 83 using the print mechanism unit 89, and the sheet 83 is discharged onto a discharge tray 87 provided in the rear side.

In the print mechanism unit 89, the carriage 93 is held to be slidable in the main-scanning direction by a main guide rod 91 and a sub guide rod 92 as guide members that bridge laterally between the left and right side plates (not illustrated), and the droplet discharging head 10 for discharging ink droplets of each color of yellow (Y), cyan (C), magenta (M), and black (Bk) is installed in the carriage 93 such that a plurality of ink discharging holes (nozzles) are arranged in a direction that intersects the main-scanning direction, and the ink droplet discharging direction is directed to the lower direction. In addition, in the carriage 93, each of the ink tanks 43 for supplying ink of each color to the droplet discharging head 10 is installed in an exchangeable manner. In the meantime, the ink tank 43 and the droplet discharging head 10 may be configured integrally to form an ink cartridge so as to be attachable to and detachable from the main body of the droplet discharging device 51.

The ink tank 43 includes an air hole communicating with the air in the upper side, a supply hole for supplying ink to the inkjet head in the lower side, and a porous body filled with ink so that the ink supplied to the droplet discharging head 10 is held by a weak negative pressure by virtue of the capillary force of the porous body. Here, although the droplet discharging head 10 is provided for each color, a single head having a plurality of nozzles capable of discharging ink droplets of respective colors may be used.

Here, the rear side (downstream side in the sheet conveying direction) of the carriage 93 is slidably fitted to the main guide rod 91, and the front side (upstream side in the sheet conveying direction) of the carriage 93 is slidably placed on the sub guide rod 92. In addition, in order to perform scanning by moving the carriage 93 in the main-scanning direction, a timing belt 100 is stretched between a driving pulley 98 rotatably driven by a main-scanning motor 97 and a driven pulley 99, and the timing belt 100 is fixed to the carriage 93 so that the carriage 93 reciprocates with the normal/reverse rotation of the main-scanning motor 97.

Meanwhile, in order to convey the sheet 83 set in the paper cassette 85 to the lower side of the droplet discharging head 10, there are provided a paper feeding roller 101 and a friction pad 102 for separately feeding the sheet 83 from the paper cassette 85, a guide member 103 for guiding the sheet 83, a carriage roller 104 for turning over and conveying the fed sheet 83, and a leading end roller 106 for defining a feeding angle of the sheet 83 from the carriage roller 104 and a carriage roller 105 attached by being pressed to the peripheral surface of the carriage roller 104. The carriage roller 104 is rotatably driven by a sub-scanning motor 107 through a gear train.

In addition, corresponding to the moving range of the carriage 93 in the main-scanning direction, there is provided a print receiving member 109 serving as a sheet guide member for guiding the sheet 83 fed from the carriage roller 104 in the lower side of the droplet discharging head 10. A carriage roller 111 and a spur 112 rotatably driven to convey the sheet 83 in the discharge direction are provided on the downstream side of the print receiving member 109 in the sheet conveying direction. Furthermore, discharging rollers 113 and 114 for conveying the sheet 83 to the discharge tray 87 and a guide member 115 that forms a discharge path are provided.

At the time of recording, the liquid discharging head 10 is driven to move in accordance with an image signal while the carriage moves, thereby to record the image signal with an amount corresponding to a line by discharging the ink droplets onto the stopped sheet 83. Thereafter, the sheet 83 is conveyed by a predetermined distance, and then, the recording of the next line is performed. When a recording completion signal or a signal indicating that the trailing end of the sheet 83 arrives at the recording area, the recording operation is terminated, and the sheet 83 is discharged.

A recovery device 117 for recovering from discharge failure in the droplet discharging head 10 is provided at a location apart from the recording area which is near the right edge in the moving direction of the carriage 93. The recovery device 117 includes a capping unit, a suctioning unit, and a cleaning unit. In the printing standby state, the carriage 93 is moved to the side of the recovery device 117, where the droplet discharging head 10 is capped by the capping unit so as to keep the discharge hole in a wet state, thereby to prevent discharge failure caused by the dried ink. In addition, the ink which is not related to the recording is discharged in the middle of a recording operation so that the ink viscosity in all the discharge holes is constantly maintained, thereby to maintain stable discharge performance.

When the discharge failure or the like occurs, the discharge hole (nozzle) of the droplet discharging head 10 is hermetically sealed by the capping unit, and vapor or the like is suctioned along with the ink from the discharge hole using the suctioning unit through the tube so as to remove ink, remnants, and the like attached to the surface of the discharge hole are removed by the cleaning unit, thereby to recover from the discharge failure. In addition, the suctioned ink is discharged to a waste ink reservoir (not illustrated) provided in the lower portion of the main body and absorbably stored in an ink absorbing body in the waste ink reservoir.

As described above, the droplet discharging device 51 according to the present embodiment includes the droplet discharging head 10, the droplet discharging head 10A, or the droplet discharging head 10B described in the first to third embodiments. Therefore, the droplet discharging device 51 may be miniaturized, the production efficiency can be improved, and the occurrence of a voltage drop can be suppressed. Therefore, the reliability and image quality of the droplet discharging device 51 can be improved.

Although the description of the present embodiment has been given of the droplet discharging device 51 as an exemplary image forming apparatus having the droplet discharging head 10, the droplet discharging head 10A, or the droplet discharging head 10B, the image forming apparatus having the droplet discharging head 10, the droplet discharging head 10A, or the droplet discharging head 10B is not limited to the droplet discharging device 51.

For example, examples of the image forming apparatus having the droplet discharging head 10, the droplet discharging head 10A, or the droplet discharging head 10B may include a printer, a facsimile, a copying machine, and the like.

According to the embodiments, the droplet discharging head can be miniaturized, the production efficiency can be improved, and the occurrence of a voltage drop caused by simultaneous driving of the piezoelectric element can be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A droplet discharging head comprising:

a nozzle substrate that includes a nozzle opening configured to discharge a droplet therethrough;

a liquid chamber substrate that includes a plurality of liquid pressure chambers communicating respectively with the nozzle openings;

a vibration plate arranged to face the nozzle substrate with the liquid chamber substrate interposed therebetween;

a plurality of piezoelectric elements that are provided to respectively face the liquid pressure chambers with the vibration plate interposed therebetween and are arranged in a predetermined direction;

a driving element provided, in a flip-chip implementation, on a flow path substrate that includes the nozzle substrate, the liquid chamber substrate, the vibration plate, and the piezoelectric elements such that the driving element is bonded to each of the piezoelectric elements; and a first reinforcing wire that is disposed to at least one of the flow path substrate and the driving element, that has a band shape extending in a direction along a row of the piezoelectric elements, and that is connected to a common electrode shared by the piezoelectric elements through at least one connecting position.

2. The droplet discharging head according to claim 1, wherein the piezoelectric elements are arranged in one of two print mode and more rows, and the driving element is implemented on the flow path substrate so as to cover an area between rows of the piezoelectric elements.

3. The droplet discharging head according to claim 2, wherein the piezoelectric element includes an individual electrode, the flow path substrate includes a plurality of electrode terminals that are respectively connected to each of the individual electrodes provided in the piezoelectric elements and are arranged along rows of the piezoelectric elements, the driving element includes a plurality of protruding electrodes arranged to respectively face the electrode terminals and is provided on the flow path substrate in a flip-chip implementation by bonding the protruding electrodes and the corresponding electrode terminals facing each other, and the first reinforcing wire is provided between rows of one of the electrode terminals and the protruding electrodes.

4. An image forming apparatus comprising the droplet discharging head according to claim 1.

5. The droplet discharging head according to claim 1, wherein the driving element is disposed on the flow path substrate so as to overlap the piezoelectric elements.

6. The droplet discharging head according to claim 1, further comprising:

a second reinforcing wire that is disposed to at least one of the flow path substrate and the driving element, that has a band shape extending in a direction along a row of the piezoelectric elements, and that is electrically connected to the protruding electrode provided in the driving element, wherein the driving element is bonded to each of the piezoelectric elements through a protruding electrode for outputting a driving voltage signal to an individual electrode of the piezoelectric element.

* * * * *